US007723920B2

(12) United States Patent
Schmitt et al.

(10) Patent No.: US 7,723,920 B2
(45) Date of Patent: May 25, 2010

(54) DRIVE CIRCUIT FOR A SWITCHABLE HEATING TRANSFORMER OF AN ELECTRONIC BALLAST AND CORRESPONDING METHOD

(75) Inventors: Harald Schmitt, München (DE); Arwed Storm, Dachau (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 160 days.

(21) Appl. No.: 12/084,465

(22) PCT Filed: Oct. 26, 2006

(86) PCT No.: PCT/EP2006/067786

§ 371 (c)(1),
(2), (4) Date: May 2, 2008

(87) PCT Pub. No.: WO2007/051751

PCT Pub. Date: May 10, 2007

(65) Prior Publication Data

US 2009/0160356 A1 Jun. 25, 2009

(30) Foreign Application Priority Data

Nov. 3, 2005 (DE) ..... 10 2005 052 525

(51) Int. Cl.
*H05B 39/00* (2006.01)

(52) U.S. Cl. ..... 315/105; 315/224; 315/291

(58) Field of Classification Search ..... 315/105, 315/106, 107, 224, 225, 226, 246, 291, 362
See application file for complete search history.

(56) References Cited

U.S. PATENT DOCUMENTS

| | | | | |
|---|---|---|---|---|
| 4,965,493 | A * | 10/1990 | Van Meurs et al. | 315/224 |
| 5,854,538 | A | 12/1998 | Krummel | |
| 6,366,031 | B2 * | 4/2002 | Klien | 315/291 |
| 6,972,531 | B2 * | 12/2005 | Krummel | 315/309 |
| 7,187,132 | B2 * | 3/2007 | Bakre | 315/94 |
| 2003/0132718 | A1 | 7/2003 | Venkatraman et al. | |

FOREIGN PATENT DOCUMENTS

| | | |
|---|---|---|
| DE | 23 50 514 | 4/1975 |
| EP | 0 748 146 A1 | 12/1996 |
| EP | 0 769 889 A1 | 4/1997 |
| WO | 93/12631 A | 6/1993 |

* cited by examiner

*Primary Examiner*—Thuy Vinh Tran

(57) ABSTRACT

The drive signal for a switchable heating transformer of an electronic ballast should be capable of being produced in a simple manner. For this purpose, the invention provides for an oscillating inverter voltage, which has a variable inverter frequency, to be tapped off, for example, at the half-bridge center point. The inverter frequency is then preferably converted into a drive signal by a charge pump (C1, C2, D1, D2). As a function of this drive signal, the heating transformer (HT) is switched. Synchronization with externally controlled sequence control of the electronic ballast is therefore also possible.

10 Claims, 1 Drawing Sheet

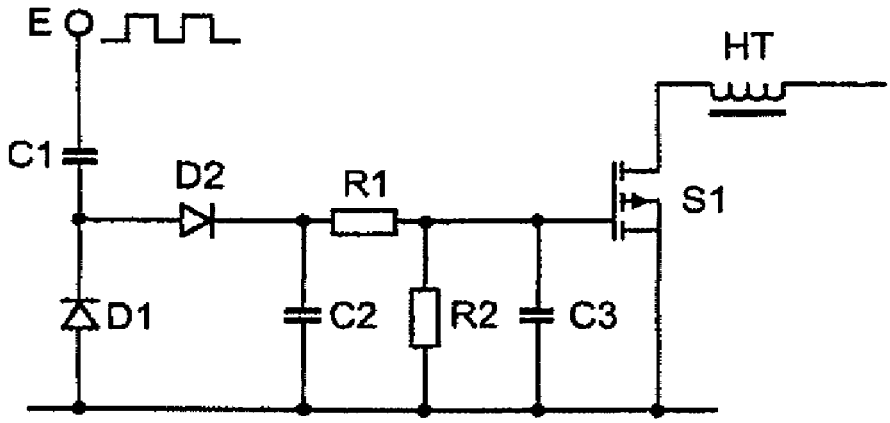
E
HT
C1
D2
R1
S1
D1
C2
R2
C3

DRIVE CIRCUIT FOR A SWITCHABLE HEATING TRANSFORMER OF AN ELECTRONIC BALLAST AND CORRESPONDING METHOD

This Application is a National Phase Application filed under 35 U.S.C. 371 claiming the benefit of an international application PCT/EP2006/067786 filed Oct. 26, 2006, having a priority benefit from an application Germany 102005052525.3 filed Nov. 3, 2005.

TECHNICAL FIELD

The present invention relates to a drive circuit for a switchable heating transformer of an electronic ballast with a circuit input terminal for picking up an oscillating inverter voltage (DC/AC converter), which has a variable inverter frequency, and a switching device, to whose output terminal the heating transformer can be connected. Furthermore, the present invention relates to a corresponding method for switching a heating transformer.

PRIOR ART

Depending on the application area, various preheating concepts for ballasts for gas discharge lamps are conventional. These include, for example, preheating via the resonant capacitor of the load circuit, via an auxiliary winding on the lamp inductor, via a resonant heating transformer and via a switchable heating transformer. The most cost-intensive but also most efficient solution for the preheating consists in a switchable heating transformer.

A corresponding drive signal and a driver or level converter, which are generally provided by an ASIC, are required for driving a switchable heating transformer. This ASIC conventionally also implements the entire sequence control. However, there are also less expensive ASICs on the market which do not provide a drive signal for a heating transformer.

In principle, it has been possible to drive the switchable heating transformer by a delay element instead of by the ASIC. With this delay element, for example a PTC thermistor, a signal can be produced which is only active for a short time directly after the device has been switched on. This method of driving using a delay element does not allow for any synchronization with remotely controlled sequence control, however.

DESCRIPTION OF THE INVENTION

The object of the present invention therefore consists in providing a simple drive circuit for a switchable heating transformer, where synchronization with remotely controlled sequence control should be possible. A corresponding method should also be made available.

According to the invention, this object is achieved by a drive circuit for a switchable heating transformer of an electronic ballast with a circuit input terminal for picking up an oscillating inverter voltage, which has a variable inverter frequency, and a switching device, to whose output terminal the heating transformer can be connected, as well as a frequency evaluation device, which is connected downstream of the circuit input terminal and with which the inverter frequency can be converted into a drive signal for the switching device.

Furthermore, the invention provides a method for switching a heating transformer of an electronic ballast, by pickup of an oscillating inverter voltage, which has a variable inverter frequency, conversion of the inverter frequency into a drive signal, and switching of the heating transformer (HT) as a function of the drive signal.

The invention is based on the concept that, prior to starting of the gas discharge lamp, the frequency in the load circuit is higher than the nominal operating mode, in which the lamp is lit and therefore the difference in frequency can be used to drive the heating transformer prior to starting of the lamp. If, therefore, the oscillating inverter voltage, which is produced, for example, by the mid-point potential of a half-bridge or full-bridge, is used for producing a drive signal for the heating transformer, synchronization with remotely controlled sequence control of the ballast is possible.

Preferably, the frequency evaluation device has a charge pump. This makes it possible, using simple means, to convert the frequency into a drive signal.

A voltage divider can be connected downstream of the charge pump. As a result, the current produced by a charge pump can be converted into a desired voltage. Favorably, this switching device comprises a MOSFET transistor. This component is distinguished as a reliable switching unit.

If the drive circuit according to the invention is installed in an electronic ballast, a half-bridge, for example, produces the oscillating inverter voltage. It is advantageous here if the amplitude of the oscillating inverter voltage is kept invariable since in this case the output signal of the charge pump is directly proportional to the frequency of the oscillating inverter voltage.

BRIEF DESCRIPTION OF THE DRAWING

The present invention will now be explained in more detail with reference to the attached drawing, which reproduces a circuit diagram of a drive circuit according to the invention.

PREFERRED EMBODIMENT OF THE INVENTION

The exemplary embodiment outlined in more detail below represents a preferred embodiment of the present invention.

The FIGURE illustrates a drive circuit for a heating transformer HT. A square-wave oscillating inverter voltage, which originates from a half-bridge mid-point (not illustrated), is present at the input E of the circuit. A charge pump is fed via the input E. Said charge pump comprises the two capacitors C1 and C2 and the two diodes D1 and D2. The capacitor C1 is connected at one terminal to the input E and at the other terminal to the cathode of the diode D1. The anode of the diode D1 is connected to ground. The cathode of the diode D1 is also connected to the anode of the diode D2. Finally, the capacitor C2 is connected on one side to the cathode of the diode D2 and on the other side to ground.

In the event of a positive input voltage, the capacitors C1 and C2 are charged via the diode D2. In this case, the magnitude of C1 determines the amount of charge supplied to C2. Given an input voltage of zero, the diode D2 turns off and the capacitor C1 is discharged via the diode D1. This operation is repeated with each period of an oscillating inverter or input voltage. The mean current transferred by the charge pump is directly proportional to the frequency of the inverter (not illustrated) since, as the frequency increases, the charging operation to the capacitor C2 takes place more and more often, with the result that its voltage increases.

The voltage present at the capacitor C2 is adjusted in a suitable manner via a resistive load. The resistive load can be in the form of an individual resistor R2 or in the form of a voltage divider R1, R2 for the more precise adjustment of the voltage. For this purpose, the voltage divider R1, R2 is positioned between the cathode of the diode D2 and ground and therefore in parallel with the capacitor C2. The center tap between the two resistors R1 and R2, i.e. the output of the voltage divider, is used for controlling a MOSFET transistor S1, for which reason its gate is connected to the center tap. In order to improve the switching response, the gate is also connected to ground via a capacitor C3. The source of the MOSFET transistor is likewise connected to ground, while the drain is connected to the heating transformer HT.

The voltage present at the output of the voltage divider is directly proportional to the frequency of the square-wave input voltage, presupposing that its amplitude is constant. Since the MOSFET transistor has a defined switching threshold, the transistor is switched on and off as a function of the frequency of the input voltage. This means that the heating transformer HT is connected via the MOSFET transistor S1, which acts as the switching element, at a high inverter frequency (preheating phase) and is disconnected at a low inverter frequency (lamp operation phase). The drive signal therefore precisely follows the frequency of the inverter and therefore predetermined sequence control, which is implemented, for example, by an ASIC.

The invention claimed is:

1. A drive circuit for a switchable heating transformer (HT) of an electronic ballast with a circuit input terminal (E) for picking up an oscillating inverter voltage, which has a variable inverter frequency, and a switching device (S1), to whose output terminal the heating transformer (HT) is connected, characterized by a frequency evaluation device, which is connected downstream of the circuit input terminal (E) and with which the inverter frequency is converted into a drive signal for the switching device (S1).

2. The drive circuit as claimed in claim 1, the frequency evaluation device having a charge pump (C1, C2, D1, D2).

3. The drive circuit as claimed in claim 2, a voltage divider (R1, R2) being connected downstream of the charge pump (C1, C2, D1, D2).

4. The drive circuit as claimed in claim 3, the switching device (S1) comprising a MOSFET transistor.

5. The drive circuit as claimed in claim 2, the switching device (S1) comprising a MOSFET transistor.

6. The drive circuit as claimed in claim 1, the switching device (S1) comprising a MOSFET transistor.

7. An electronic ballast for a gas discharge lamp with a half-bridge, a load circuit, whose oscillating inverter voltage is produced at the half-bridge, and a drive circuit as claimed in claim 1.

8. The electronic ballast as claimed in claim 7, the amplitude of the oscillating inverter voltage being kept invariable.

9. A method for switching a heating transformer (HT) of an electronic ballast, characterized by pickup of an oscillating inverter voltage, which has a variable inverter frequency, conversion of the inverter frequency into a drive signal, and switching of the heating transformer (HT) as a function of the drive signal.

10. The method as claimed in claim 9, the conversion of the inverter frequency into a drive signal taking place by means of a charge pump (C1, C2, D1, D2) and in the process the amplitude of the oscillating inverter voltage being kept constant.

* * * * *